US005697420A

United States Patent [19]

Mori et al.

[11] Patent Number: 5,697,420

[45] Date of Patent: Dec. 16, 1997

[54] METHOD OF MANUFACTURING VEHICLE STEERING WHEEL METAL CORE UNIT

[75] Inventors: Kenji Mori, Gifu; Tetsuya Takamori, Aichi, both of Japan

[73] Assignee: Toyoda Gosei Co., Ltd., Aichi-Ken, Japan

[21] Appl. No.: 594,408

[22] Filed: Jan. 31, 1996

[51] Int. Cl.[6] ..... B22D 19/04

[52] U.S. Cl. ..... 164/98

[58] Field of Search ..... 164/98, 100

[56] References Cited

U.S. PATENT DOCUMENTS 4,313,249 2/1982 Douthwaite ..... 164/98

FOREIGN PATENT DOCUMENTS 2691656 12/1993 France ..... 164/98

1-273767 11/1989 Japan .

*Primary Examiner*—Kuang Y. Lin

*Attorney, Agent, or Firm*—Cushman Darby & Cushman IP Group of Pillsbury Madison & Sutro LLP

[57] ABSTRACT

A method of manufacturing a vehicle steering wheel metal core unit is provided. The core unit includes a tubular boss member 24 defining a tapered portion at the lower inner peripheral surface thereof, a groove 29 at the lower end of the inner peripheral surface thereof, and a compression-deformable annular projection 30 at the bottom surface thereof. The method includes setting the boss member in die casting mold 17 and closing the mold such that the molding surfaces 18*a*, 19*a* thereof are brought into pressure contact with the upper end surface 24*a* and the lower end surface 24*b* of the boss member, respectively, thereby plastically deforming the annular projection 30. Thereafter, die casting metal is injected into the mold around the boss member 24. With this method, the steering wheel metal core unit can be manufactured without the generation of fins and deformation of a tapered portion adapted to be coupled to the steering wheel shaft. Thus, manufacturing man-hours and cost can be reduced.

2 Claims, 6 Drawing Sheets

METHOD OF MANUFACTURING VEHICLE STEERING WHEEL METAL CORE UNIT

BACKGROUND OF THE INVENTION

The present invention relates to a method of manufacturing a vehicle steering wheel metal core unit comprising a boss adapted to be coupled to the steering shaft and covered with a die-casting metal.

DESCRIPTION OF RELATED ART

As is known from Japanese Laid-Open Patent Publication No. HI-273767, the conventional steering wheel metal core unit has been formed in such a manner that a spoke portion connecting a boss and a ringlike portion of the metal core unit is die-cast by using an aluminum alloy or the like to thereby save time and labor for welding all the parts of the metal core unit.

As shown in FIG. 1, the above-described steering wheel metal core unit 1 has been constructed such that a steel boss 2 connected to a steering shaft 5 has a serrated portion 2*a* and a downwardly tapered portion 2*b* at the upper and lower portions, respectively, of the inner peripheral surface thereof in correspondence to a serrated portion 5*a* and a tapered portion 5*b* of the steering shaft 5, and is covered with a die-casting metal 3.

The connection of the metal core unit 1 with the steering shaft 5 has been performed in such a manner that the serrated portion 5*a* and the tapered portion 5*b* of the steering shaft 5 are respectively fitted into the serrated portion 2*a* and the tapered portion 2*b* of the boss 2 so as to allow a male screw portion 5*c* formed on top of the shaft 5 to project upwardly from the boss 2 and a nut 6 is screw-fitted about the male screw portion 5*c*.

As shown in FIG. 2, a casting mold 7 used for casting the steering wheel metal core unit 1 has been constructed such that it is provided with a sectional die 8 having a molding surface 8*a* coming into contact with an upper end surface 4*c* of a tubular boss member 4 and a sectional die 9 having a core pin 9*b* to be inserted into a tapered portion 4*b* of the boss member 4 and a molding surface 9*a* coming into contact with a lower end surface 4*d* of the boss member 4.

With the above structure, the steering wheel metal core unit 1 has been manufactured in such a manner that the boss member 4 is fitted about the core pin 9*b* when the mold is opened and the molding surfaces 8*a*, 9*a* of the sectional dies 8, 9 are held in pressure contact with the upper and lower end surfaces 4*c*, 4*d* of the boss member 4 when the mold is closed. Then, the die-casting metal 3 is injected into a mold cavity 7*a* surrounding the boss member 4.

In the above case, the boss member 4 is typically formed to have a hole portion 4*a* and a tapered portion 4*b* at the upper and lower inner peripheral portions thereof, respectively. Further, the hole portion 4*a* is where the serrated portion 2*a* of the boss 2 is formed. This serrated portion 2*a* is formed on the inner peripheral surface of the hole portion 4*a* by broaching after casting the die-casting metal 3 so that it is arranged at the center of the steering wheel metal core 1.

According to the conventional method for manufacturing the steering wheel metal core unit, however, it has been necessary to firmly clamp the upper and lower end surfaces, 4*c*, 4*d* of the boss member 4 between the lower surface 8*a* of the sectional die 8 and the upper surface 9*a* of the sectional die 9 so that no fins of the die-casting material 3 generate at the inner peripheral surface of the boss member 4.

If the dimensional accuracy of the overall length of the boss member 4 and that of the casting mold 7 are not high, the tapered portion 4*b* of the boss member 4 will be plastically deformed when the casting mold 7 is closed, which results in that the precision of the tapered surface such as a predetermined taper angle cannot be ensured, and chattering occurs after the boss is connected to the steering shaft 5. For this reason, the strict dimensional accuracy of the overall length of the boss member 4 and the casting mold 7 has been demanded in order to control the dimensional accuracy in the conventional manufacturing method, thereby increasing man-hour and cost for manufacturing the steering wheel metal core unit 1.

SUMMARY OF THE INVENTION

The present invention solves the above-mentioned problems. It is an object of the invention to provide a method of manufacturing a vehicle steering wheel metal core unit by which the steering wheel metal core unit can be manufactured without causing the generation of fins or deformation of the tapered portion of the unit, even if not so strict dimensional accuracy control is performed for the boss member and the casting mold, reducing the manufacturing man-hour and cost.

The method according to the present invention is for manufacturing a vehicle steering wheel metal core unit which comprises a tubular boss having a downwardly and outwardly tapered portion at the lower inner peripheral surface thereof and covered with a die casting metal. The boss is adapted to be connected to a steering shaft. The boss includes a tubular boss member having defining the tapered portion. A groove is provided at the lower end of the inner peripheral surface of the boss member, and a compression-deformable annular projection is defined at the bottom surface of the boss member. The boss member is set in a die casting mold. The mold is closed and the upper and lower end surfaces of the boss member are held in pressure contact with molding surfaces of the die casting mold so that the annular projection is plastically deformed, without deforming the tapered portion. Die casting metal is injected around the boss member within the die casting mold.

It is preferable that the width of the groove of the boss member is 1.0 mm or more, and the height and width of the annular projection are 0.2 mm or more and 0.5 mm or more, respectively.

According to the manufacturing method of the present invention, the boss member is set in the die casting mold to bring the molding surfaces thereof into pressure contact with the upper and lower end surfaces of the boss member, the die casting mold is closed so that the annular projection of the boss member is plastically deformed; and the die casting metal is injected around the boss member in the mold to thereby manufacture the steering wheel metal core unit. The compression-deformable annular projection formed on the bottom surface of the boss member is crushed positively when the die casting mold is closed. Since the groove is provided at the lower end of the inner peripheral surface of the boss member and the annular projection is provided at the bottom surface thereof, a stress concentration tends to occur at the annular projection. Even if the annular projection is plastically deformed, the groove acts as a buffer so that it is possible to prevent the tapered portion provided at the lower inner peripheral surface of the boss member from being affected.

Since the upper and lower end surfaces of the boss member are pressed by the molding surfaces of the die casting mold under a predetermined pressure, it is possible to manufacture the steering wheel metal core unit without the generation of fins at the inner peripheral surface of the boss member. Moreover, the sealing property of the die casting metal is further improved because the annular projection is plastically deformed and adheres to the molding surfaces thereof at the lower end surface of the boss member.

Furthermore, even if the dimensional accuracy of the boss member and die casting mold is low, the plastically compression-deformed annular projection compensates for the dimensional errors so that a wide range of dimensional tolerance for the boss member and die casting mold can be set because the compression-deformable annular projection at the bottom surface of the boss member is crushed positively when the mold is enclosed.

Accordingly, in the method of manufacturing the vehicle steering wheel metal core unit according to the invention, it is possible to manufacture the steering wheel metal core unit without the generation of fins or deformation of the tapered portion, even if not so strict dimensional accuracy control is performed for the boss member and die casting mold. As a result, manufacturing man-hours and cost can be reduced.

As noted above, it is desirable that the width of the groove of the boss member be 1.0 mm or more and the height and width of the annular projection be 0.2 mm or more and 0.5 mm or more, respectively. If the width of the groove is less than 1.0 mm, the compression-deformable annular projection at the bottom surface thereof cannot be first crushed when the die casting mold is closed so that the tapered portion tends to be deformed. If the height of the annular projection is less than 0.2 mm, the amount of crush of the boss member is reduced and no wide range of dimensional tolerance can be set. In addition, since the annular projection is plastically deformed, a slight elastic deformation occurs, and the upper end surface of the boss member is sealed with the molding surfaces of the die casting mold due to the reaction force of the elastic deformation when the mold is closed. Therefore, if the width of the annular projection is less than 0.5 mm, the annular projection is plastically deformed easily, the elastically-deformed part of the annular projection disappears, and fins of the die casting material tend to generate at the upper end surface of the boss member.

DETAILED DESCRIPTION OF THE PRESENTLY PREFERRED EXEMPLARY EMBODIMENT

One embodiment of the present invention will now be described by referring to the accompanying drawings.

Figure 3:
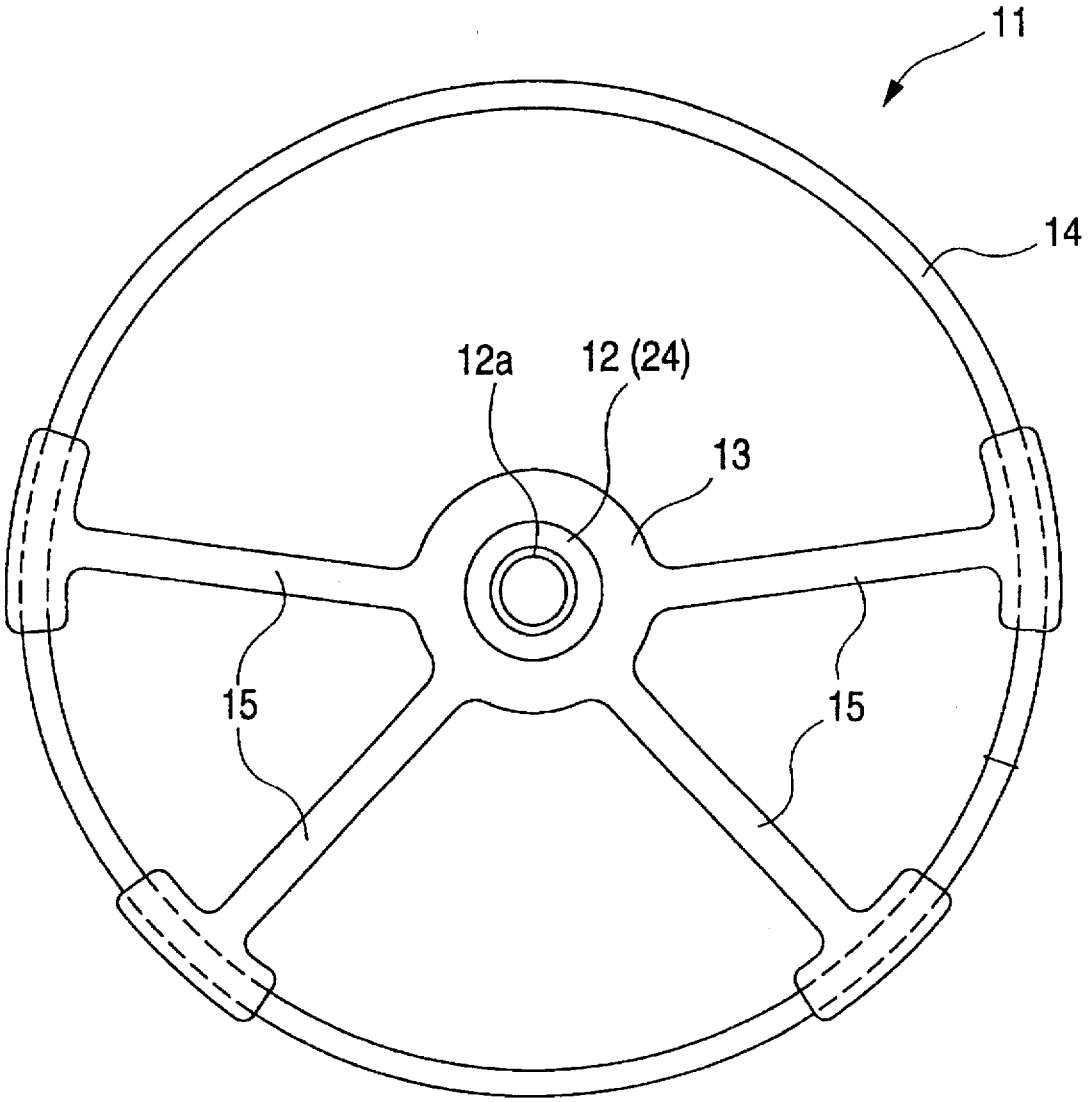
FIG. 3 is a plan view of a steering wheel metal core unit manufactured by a method according to the embodiment of the present invention.
Figure 4:
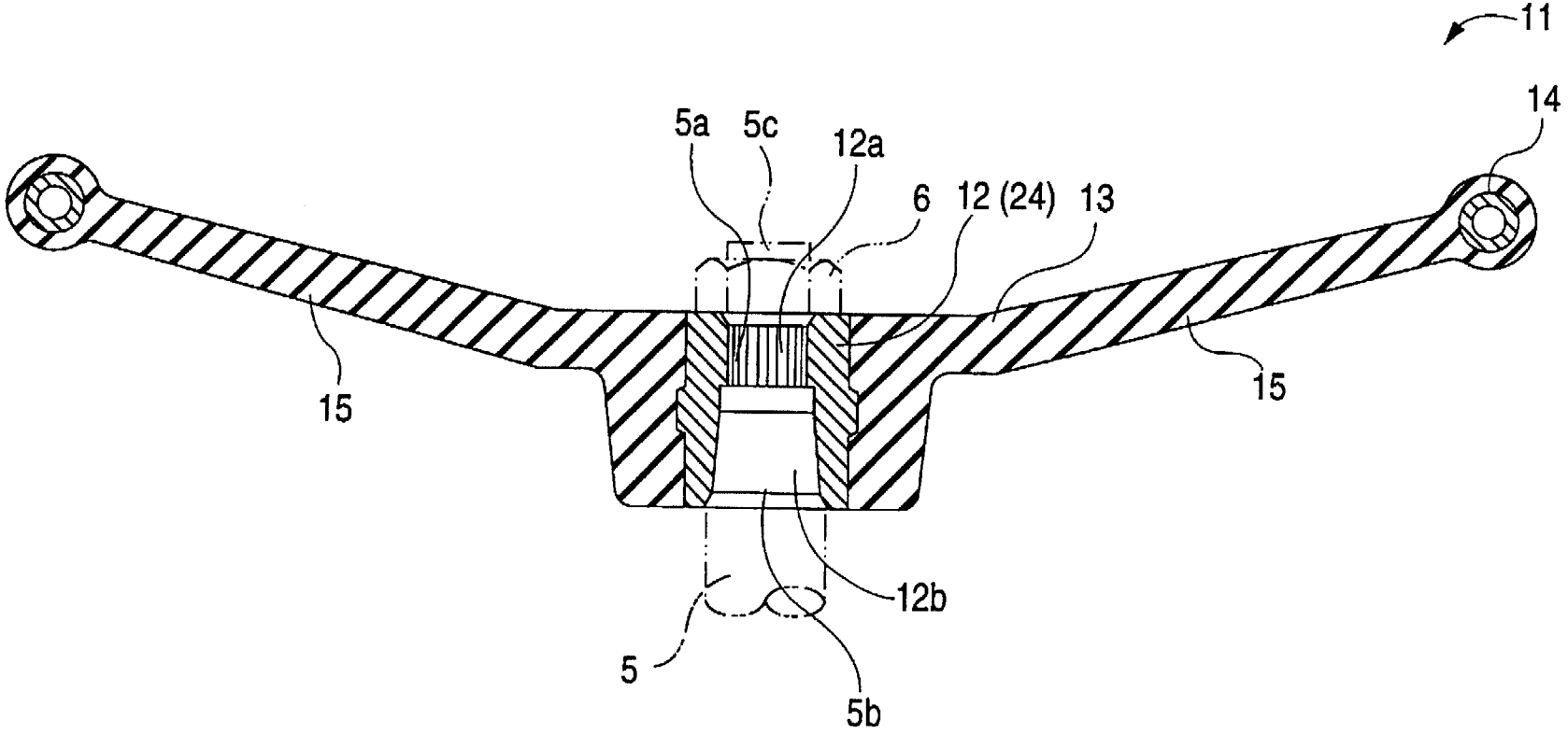
FIG. 4 is a sectional view of a steering wheel metal core unit manufactured according to the embodiment of the present invention.

As shown in FIGS. 3 and 4, a steering wheel metal core unit 11 to be manufactured by the method according to this embodiment comprises a boss 12 which is made of a boss member 24 and covered with a die casting metal 13 such as an aluminum alloy or the like, and the die casting metal 13 constitutes four spokes 15 which are extended up to a ring 14 made of a steel pipe.

The boss 12 is provided with a serrated portion 12*a* at the upper inner peripheral surface thereof which corresponds to a serrated portion 5*a* of a steering shaft 5 and a downwardly and outwardly tapered portion 12*b* at the lower inner peripheral surface thereof which corresponds to a tapered portion 5*b* of the steering shaft 5.

Figure 5:
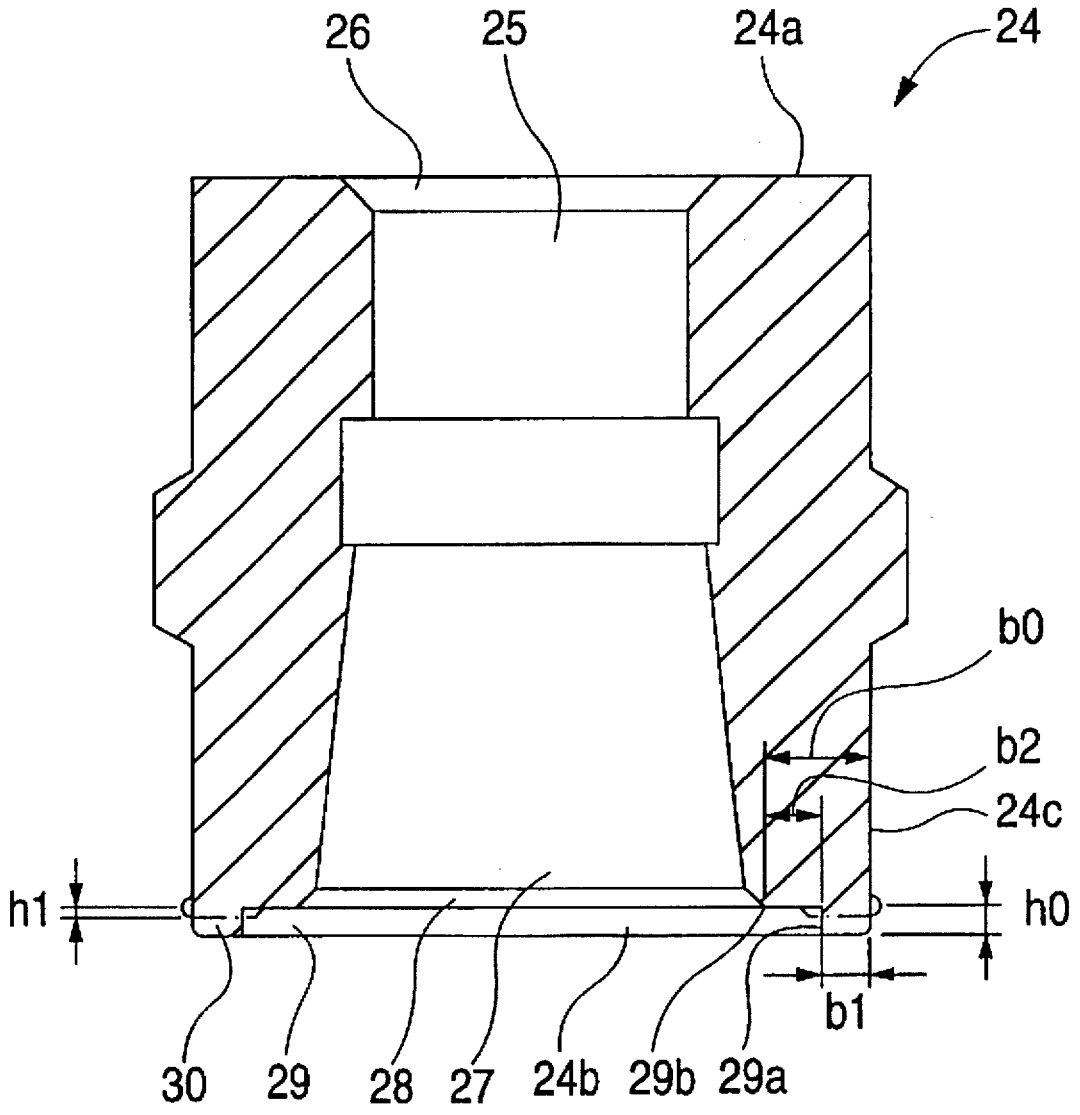
FIG. 5 is a sectional view of a boss member which is used in the method according to the embodiment of the present invention.

The boss member 24 which forms the boss 12 is a substantially cylindrical tube in the form of a steel forged product as shown in FIG. 5. A hole portion 25 which includes the serrated portion 12*a* is formed at the upper inner peripheral surface, and an upwardly and outwardly tapered surface 26 is formed in the upper part of the hole portion 25.

A tapered portion 27 which becomes the tapered portion 12*b* of the boss 12 is formed at the lower inner peripheral surface of the boss member 24. A groove 29 is formed at the lower end of the inner peripheral surface, and a compression-deformable annular projection 30 is provided on the bottom surface thereof. Also, a chamfered part 28 is formed at the lower end of the tapered portion 27.

In the illustrated embodiment, the height h0 of the annular projection is 0.3 mm and the width b0 of the bottom surface of the boss member 24 (the distance from a start end 29*b* of the groove 29 at the bottom surface of the boss material 24 to an outer peripheral surface 24*c* of the boss member 24) is 2.8 mm. The width b1 of the annular projection 30 is 1.6 mm and the width b2 of the groove 29 (the distance from the start end 29*b* of the groove 29 at the bottom surface of the boss member 30 to a peripheral wall 29*a*) is 1.2 mm. Also, the outer diameter of the bottom surface of the boss member 24 (the diameter of the outer peripheral surface of the annular projection 30) is 24.4 mm.

Figure 6:
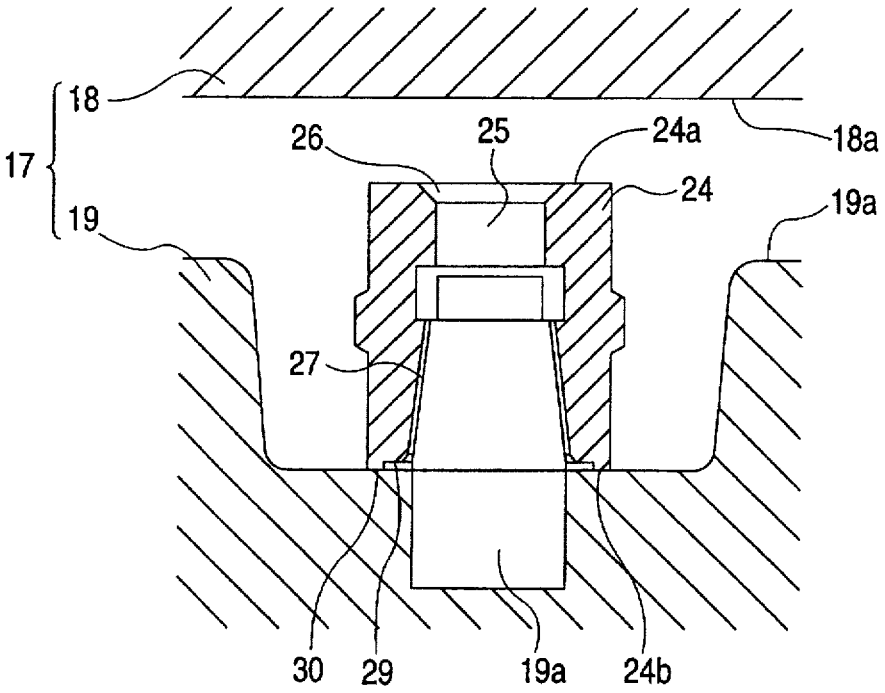
FIG. 6 is a sectional view which shows a condition in which the boss member is set in the die casting mold which is used in the embodiment of the present invention.

A casting mold 17 to be used in the casting of this steering wheel metal core unit 1 is provided with two sectional dies 18, 19, as shown in FIG. 6. The sectional die 18 is stationary and provided with a molding surface 18*a* which can cast the upper surfaces of the periphery of the boss and the spokes 15. The sectional die 19 is movable and provided with a molding surface 19*a* which can cast the lower surfaces of the periphery of the boss 12 and the spokes 15, and a core pin 19*b* to be inserted into the boss member 24. The core pin 19*b* is made of a material harder than that of the boss member 24.

Figure 7:
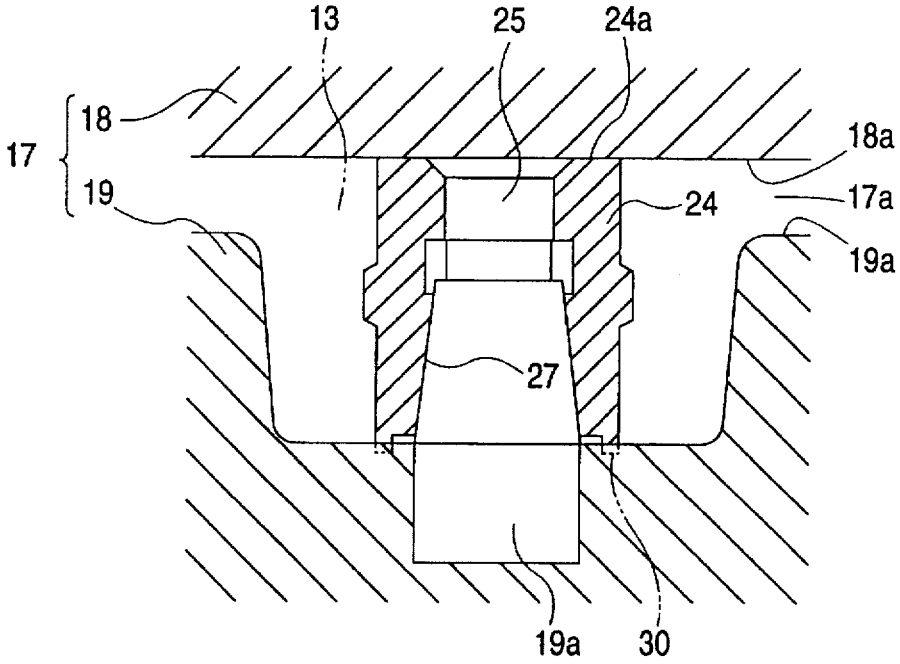
FIG. 7 is a sectional view which shows a condition in which the die casting mold is closed according to the embodiment of the present invention.

When the steering wheel metal core unit 11 is cast in the casting mold 17, the boss member 24 is first set in the core pin 19*b* and the ring portion 14 is set in the sectional die 19, as shown in FIG. 6. Then, the casting mold is closed as shown in FIG. 7. In this case, the molding surfaces 18*a*, 19*a* are brought into pressure contact with the upper and lower end surfaces 24*a*, 24*b* of the boss member 24, respectively, so that the annular projection 30 of the boss member 24 is plastically deformed as shown by the two-dots-chain line in FIG. 5. In the instant embodiment, the casting mold is closed in such a way that the height h1 of the annular projection 30 becomes approximately 0.1 mm.

Then, the die casting metal 13 is injected into the cavity 17*a* of the die casting mold 17, and the serrated portions are formed at the inner peripheral surface of the hole 25 of the boss member 24 by broaching after the dies are parted so that the steering wheel metal core unit 11 provided with the predetermined boss 12 is manufactured.

In the method of manufacturing the vehicle steering wheel metal core unit 11 according to the embodiment, the compression-deformable annular projection 30 provided at the bottom surface thereof is crushed positively. Since the annular projection 30 comprises the groove 29 at the lower end of the inner peripheral surface of the boss member 24 and is provided at the bottom surface of the boss member 24, a stress concentration tends to generate at the annular projection 30, and even if the annular projection 30 is plastically deformed, the groove 29 acts as a buffer and the tapered portion provided at the lower inner peripheral surface of the boss member 24 is not affected thereby.

Figure 1:
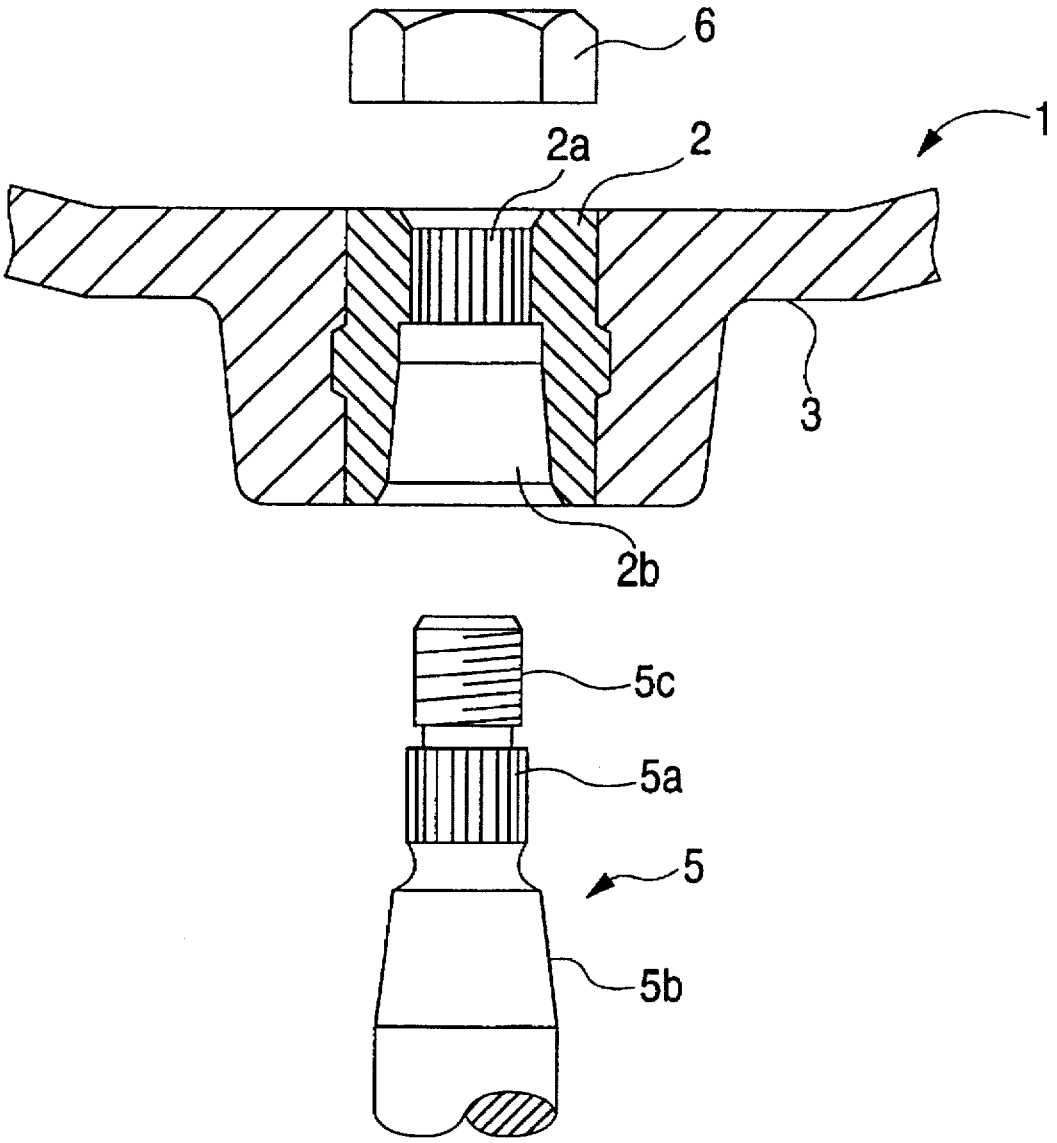
FIG. 1 PRIOR ART
FIG. 1 is a sectional view of a steering wheel metal core unit manufactured by a conventional manufacturing method.
Figure 2:
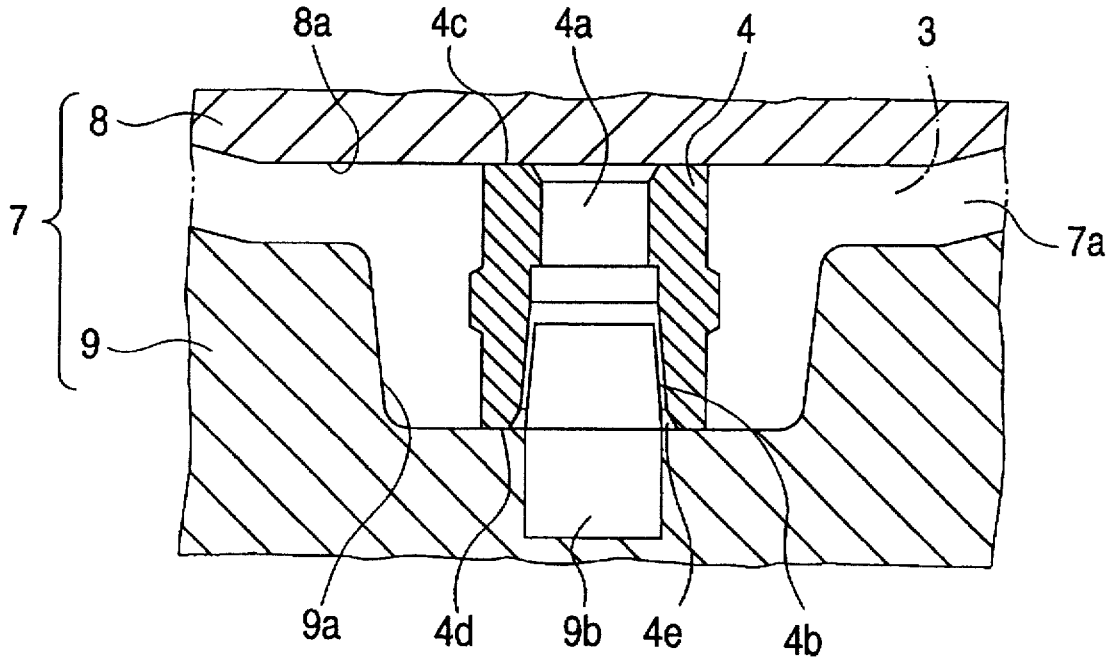
FIG. 2 PRIOR ART
FIG. 2 is a sectional view of a die casting mold according to the conventional manufacturing method shown with the mold closed.

Conventionally, a chamfered part **4*e* has been formed at the lower end of the tapered portion 4*b* of the boss member 4 (refer to FIG. 2). It is therefore conceivable that the chamfered part 4*e* is so deformed as to reduce the size of that part 4*e* in the vertical direction at the time of closing the mold and the tapered portion 4*b* is not adversely affected by the molding operation. However, since the surfaces of the tapered portion 4*b* and the chamfered part 4*e* are continuous without depression, the surface of the tapered portion 4*b* is also affected when the chamfered part 4*e* is plastically compression-deformed, reducing the surface accuracy of the tapered portion 4*b***.

It is noted that the vertical direction referred to in this specification indicates the direction extending vertically along the steering wheel shaft when the steering wheel metal core unit is mounted on a vehicle, and does not mean the actual vertical direction when the steering wheel metal core unit is manufactured. That is, the metal core unit may be cast by placing the tapered portion of the boss member at an upper part thereof or by forming the die casting mold to be opened and closed in the horizontal direction at the time of actual casting.

Since the upper and lower end surfaces **24*a*, 24*b* of the boss member 24 are pressed by the molding surfaces 18*a*, 19*a* of the die casting mold 17 in the manufacturing method according to the embodiment, it is possible to cast the steering wheel metal core unit 11 without the generation of fins at the inner peripheral surface of the boss member 24**.

In addition, since the annular projection 30 is plastically deformed to adhere to the molding surface **19*a* on the lower end surface 24*b* of the boss member 24, the sealing property of the die casting metal 13** is further improved.

Furthermore, in the manufacturing method of this embodiment, the compression-deformable annular projection 30 provided at the bottom surface of the boss member 24 is crushed positively at the time of closing the mold. Even if the dimensional accuracy of the boss member 24 and the die casting mold 17 is low, the compression-deformable annular projection 30 compensates for their errors so that a wide range of dimensional tolerance for the boss member 24 and the die casting mold 17 can be set and the same effects as described with respect to the operation and effect of the invention can be obtained.

In this embodiment, the width b2 of the groove 29 to be formed in the boss member 24 is set to 1.2 mm, but it is preferable that this width be set to 1.0 mm or more, because, if it is less than 1.0 mm, the compression-deformable annular projection 30 provided at the bottom surface may not be first crushed when the mold is closed, causing the deformation of the tapered portion 27.

Also, in this embodiment, the height h0 of the annular projection 30 provided in the boss member 24 is shown to be 0.3 mm, but it is desirable that this height h0 be 0.2 mm or more, because if it is less than 0.2 mm, the amount of crush of the annular projection is reduced and a wide range of dimensional tolerance cannot be set.

Furthermore, although the width b1 of the annular projection 30 is shown to be 1.6 mm in the embodiment, it is desirable that this width b1 be set to 0.5 mm or more, because when the mold is closed, the annular projection 30 is plastically deformed, a slight elastic deformation occurs at the same time, and the molding surface **18*a* of the sectional die 18 is sealed with the upper end surface 24*a* of the boss member 24 due to the reaction force of the elastic deformation. Therefore, if the width b1 of the annular projection 30 is less than 0.5 mm, the plastic deformation thereof occurs easily, the elastically deformed part thereof disappears, and fins tend to generate at the upper end surface 24*a* of the boss member 24**.

Furthermore, the annular projection 30 is formed flush with the outer peripheral surface of the boss member 24 in the illustrated embodiment, but it may be formed in such a way that it is set back from the outer peripheral surface of the boss member 24. However, since it is desirable that the width b2 of the groove 29 be 1.0 mm or more and the width b1 of the annular projection 30 be 0.5 mm or more as mentioned above, it is preferable that the annular projection 30 becomes substantially flush with the outer peripheral surface **24*c* of the boss member 24 because by so doing, the boss member 24** may be easily designed.

While the invention has been described in connection with what is presently considered to be the most practical and preferred embodiment, it is understood that the invention is not limited to the disclosed embodiment but, on the contrary is intended to cover various modifications and equivalent arrangements included within the spirit and scope of the appended claims.

What is claimed is:

1. A method of manufacturing a vehicle steering wheel metal core unit, the unit comprising a tubular boss having a tapered portion formed at the lower inner peripheral surface thereof adapted to be connected to a steering wheel shaft, and a die cast metal covering the tubular boss, the tubular boss including a tubular boss member defining the tapered portion, a groove at a lower end of an inner peripheral surface of the boss member and a compression-deformable annular projection at a bottom surface of the boss member, the method including:

setting the tubular boss member in a die casting mold;

closing the mold and holding upper and lower end surfaces of the boss member in pressure contact with molding surfaces of the die casting mold so that the annular projection is plastically deformed, thereby preventing the tapered portion from deforming; and injecting die casting metal into the mold around the boss member.

2. A method of manufacturing a vehicle steering wheel metal core unit according to claim 1, wherein, before deforming the groove of the boss member has a width of 1.0 mm or more, and a height and width of the annular projection of the boss member are 0.2 mm or more and 0.5 mm or more, respectively.

* * * * *